US007275946B2

(12) United States Patent
Ohtaka et al.

(10) Patent No.: US 7,275,946 B2
(45) Date of Patent: Oct. 2, 2007

(54) ELECTRIC CONNECTOR FOR WIRING HARNESS HAVING A SHORT CIRCUIT TERMINAL

(75) Inventors: Kazuto Ohtaka, Shizuoka (JP); Toshiharu Takahashi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/513,226

(22) Filed: Aug. 31, 2006

(65) Prior Publication Data

US 2007/0054547 A1 Mar. 8, 2007

(30) Foreign Application Priority Data

Sep. 5, 2005 (JP) ..... 2005-256976

(51) Int. Cl.
*H01R 29/00* (2006.01)

(52) U.S. Cl. ..... 439/188; 439/595; 200/51.1

(58) Field of Classification Search ..... 439/188, 439/595; 200/51.1

See application file for complete search history.

(56) References Cited

U.S. PATENT DOCUMENTS 5,647,754 A * 7/1997 Kohno ..... 439/188

* cited by examiner

*Primary Examiner*—Javaid H. Nasri
(74) *Attorney, Agent, or Firm*—Kratz, Quintos & Hanson, LLP

(57) ABSTRACT

The electric connector includes: at least two terminal fittings; a connector housing including terminal-receiving chambers each receiving the terminal fitting and having a locking piece for locking the terminal fitting; and a short circuit terminal for electrically connecting the two terminal fittings to each other, wherein when the connector is coupled with a mating connector, electrical connection between the two terminal fittings attained by the short circuit terminal is removed, wherein when the terminal fitting is inserted into the terminal-receiving chamber, the locking piece is once resiliently deformed and thereafter locks the terminal fitting, wherein the connector housing is provided with a bending space in which the locking piece is positioned when the locking piece is resiliently deformed, wherein the short circuit terminal includes a resilient contacting piece which passes through the bending space and comes in resilient contact with one terminal fitting of the two terminal fittings.

5 Claims, 12 Drawing Sheets

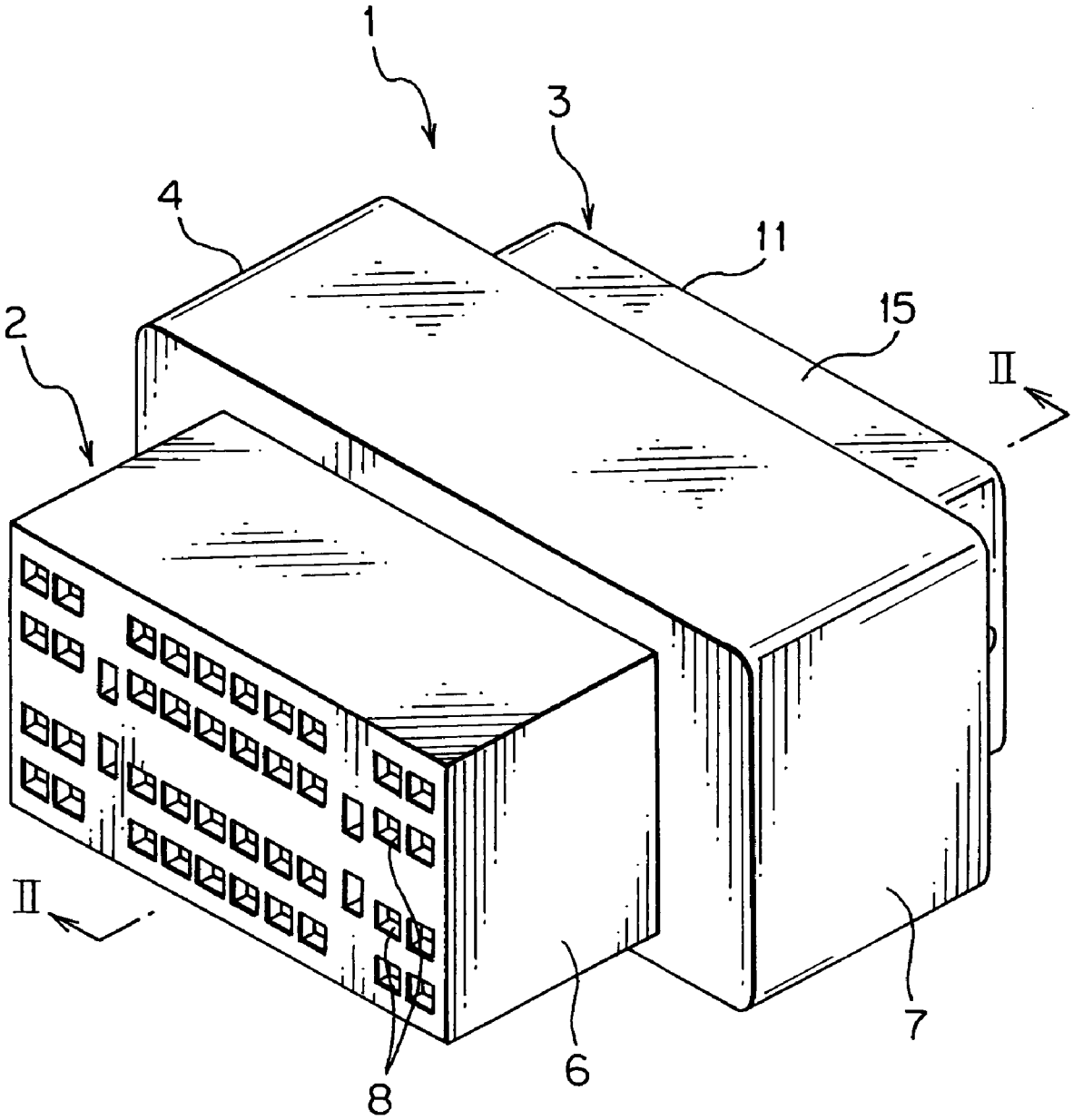
FIG. 1
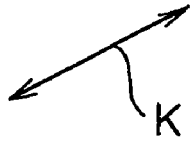

ELECTRIC CONNECTOR FOR WIRING HARNESS HAVING A SHORT CIRCUIT TERMINAL

BACKGROUND OF THE INVENTION (1) Field of the Invention

The present invention relates to an electric connector used for connection of electric wires and to an electric connector unit including the connector.

(2) Description of the Related Art

Various electronic instruments are mounted on a motor vehicle as a mobile unit. The motor vehicle includes a wiring harness for transmitting electric power and control signals to the electronic instruments. The wiring harness includes a plurality of electric wires and connectors. The electric wire is a so-called coated wire which includes an electrically conductive core wire and an electrically insulating coating that coats the core wire.

A connector (i.e. electric connector) to be connected to an air bag as the electronic instrument includes an electrically insulating connector housing, a terminal fitting received in the connector housing and connected to a gas generator of the air bag, another terminal fitting received in the connector housing and grounded (i.e. connected to the ground), and a short circuit terminal for connecting the terminal fittings to each other.

The two terminal fittings described above are connected to the gas generator and the ground, respectively, through respective electric wires. The short circuit terminal disconnects the two terminal fittings from each other when the connector is coupled with a mating connector, while the short circuit terminal connects the two terminal fittings to each other when the coupling of the connector and the mating connector is removed.

The short circuit terminal includes a body to be received in the connector housing and a pair of resilient contacting pieces continuing to the body. Each of the pair of the resilient contacting pieces is formed in a belt-shape and comes in resilient contact with the terminal fitting (i.e. comes in contact with the terminal fitting being resiliently deformed). The resilient contacting pieces are formed in parallel to each other. That is, the short circuit terminal (i.e. the body of the short circuit terminal) is not arranged between the two terminal fittings but arranged at a position where the short circuit terminal overlaps with the two terminal fittings.

When the connector is disconnected from the mating connector, for example, for subjecting the air bag to the maintenance thereof, static electricity might be undesirably supplied to the gas generator to cause malfunction of the gas generator. This is a reason why the short circuit terminal connects the two terminal fittings to each other when the coupling of the connector and the mating connector is removed.

As for the conventional connector described above, since the short circuit terminal is arranged at a position where the short circuit terminal overlaps with the two terminal fittings, therefore in order to receive the short circuit terminal, the connector housing needs a space for receiving the two terminal fittings. That is, the connector housing needs a space to receive the short circuit terminal therein, resulting in that a size of the connector housing tends to be enlarged, that is, a size of the connector tends to be enlarged.

SUMMARY OF THE INVENTION

It is therefore an objective of the present invention to solve the above problem and to provide a connector including a short circuit terminal that electrically connects the two terminal fittings to each other when the coupling of the connector and the mating connector is removed, thereby preventing the connector from being enlarged, and to provide a connector unit including such a connector.

In order to attain the above objective, the present invention is to provide a connector including:

at least two terminal fittings;

a connector housing including terminal-receiving chambers each receiving the terminal fitting and having a locking piece for locking the terminal fitting; and a short circuit terminal for electrically connecting the two terminal fittings to each other, wherein when the connector is coupled with a mating connector, electrical connection between the two terminal fittings attained by the short circuit terminal is removed, wherein when the terminal fitting is inserted into the terminal-receiving chamber, the locking piece is once resiliently deformed and thereafter locks the terminal fitting, wherein the connector housing is provided with a bending space in which the locking piece is positioned when the locking piece is resiliently deformed, wherein the short circuit terminal includes a resilient contacting piece which passes through the bending space and comes in resilient contact with one terminal fitting of the two terminal fittings.

With the construction described above, since the resilient contacting piece of the short circuit terminal is arranged in the bending space of the locking piece, therefore it is not necessary to provide an exclusive space for the resilient contacting piece within the connector housing and therefore, the connector can be made compact.

Preferably, the short circuit terminal further includes a contacting piece which comes in contact with another terminal fitting of the two terminal fittings.

With the construction described above, the connection between the two terminal fittings attained by the short circuit terminal can be removed when the connectors are coupled with each other only by providing the mating connector with a portion for parting the resilient contacting piece from the terminal fitting. Therefore, it is possible to restrict force that presses the connectors in a direction in which the connectors approach each other when the connectors are coupled with each other. Therefore, the connector can be easily coupled with the mating connector.

Preferably, the connector further includes a spacer which is detachable from the connector housing and prevents the terminal fitting from coming out from the terminal-receiving chamber when the spacer is attached to the connector housing, wherein the spacer includes a restricting part for restricting resilient deformation of the locking piece when the restricting part is attached to the connector housing, wherein the restricting part is provided with a through hole which passes the resilient contacting piece therethrough and allows the resilient contacting piece to come in contact with the one terminal fitting.

With the construction described above, since the restricting part of the spacer is provided with the through hole which passes the resilient contacting piece therethrough, therefore interference between the restricting part and the short circuit terminal can be prevented from occurring and the connector can be prevented from being enlarged.

Preferably, the short circuit terminal is arranged between the two terminal fittings.

With the construction described above, a space for providing the terminal fittings can be made small in comparison with a case in which the short circuit terminal is arranged at a position where the short circuit terminal overlaps with the two terminal fittings. Therefore, the connector can be prevented from being enlarged.

In order to attain the above objective, the present invention is to provide a connector unit including:

a connector; and a mating connector which is to be coupled with the connector and includes a releasing part for removing connection between the two terminal fittings attained by the short circuit terminal when the mating connector is coupled with the connector.

With the construction described above, since the resilient contacting piece of the short circuit terminal is arranged in the bending space of the locking piece, therefore it is not necessary to provide an exclusive space for the resilient contacting piece within the connector housing and therefore, the connector can be made compact and the connector unit can also be made compact.

Preferably, the releasing part is provided at a position where the releasing part is enterable in the bending space when the connector and the mating connector are coupled with each other.

With the construction described above, since the releasing part is enterable in the bending space, therefore it is not necessary to provide an exclusive space for receiving the releasing part. Therefore, the connector can be made compact and the connector unit can also be made compact.

BRIEF DESCRIPTION OF THE DRAWINGS

FIG. 1 is a perspective view illustrating a connector unit including a connector according to a preferred embodiment of the present invention;

DESCRIPTION OF THE PREFERRED EMBODIMENTS

Figure 2:
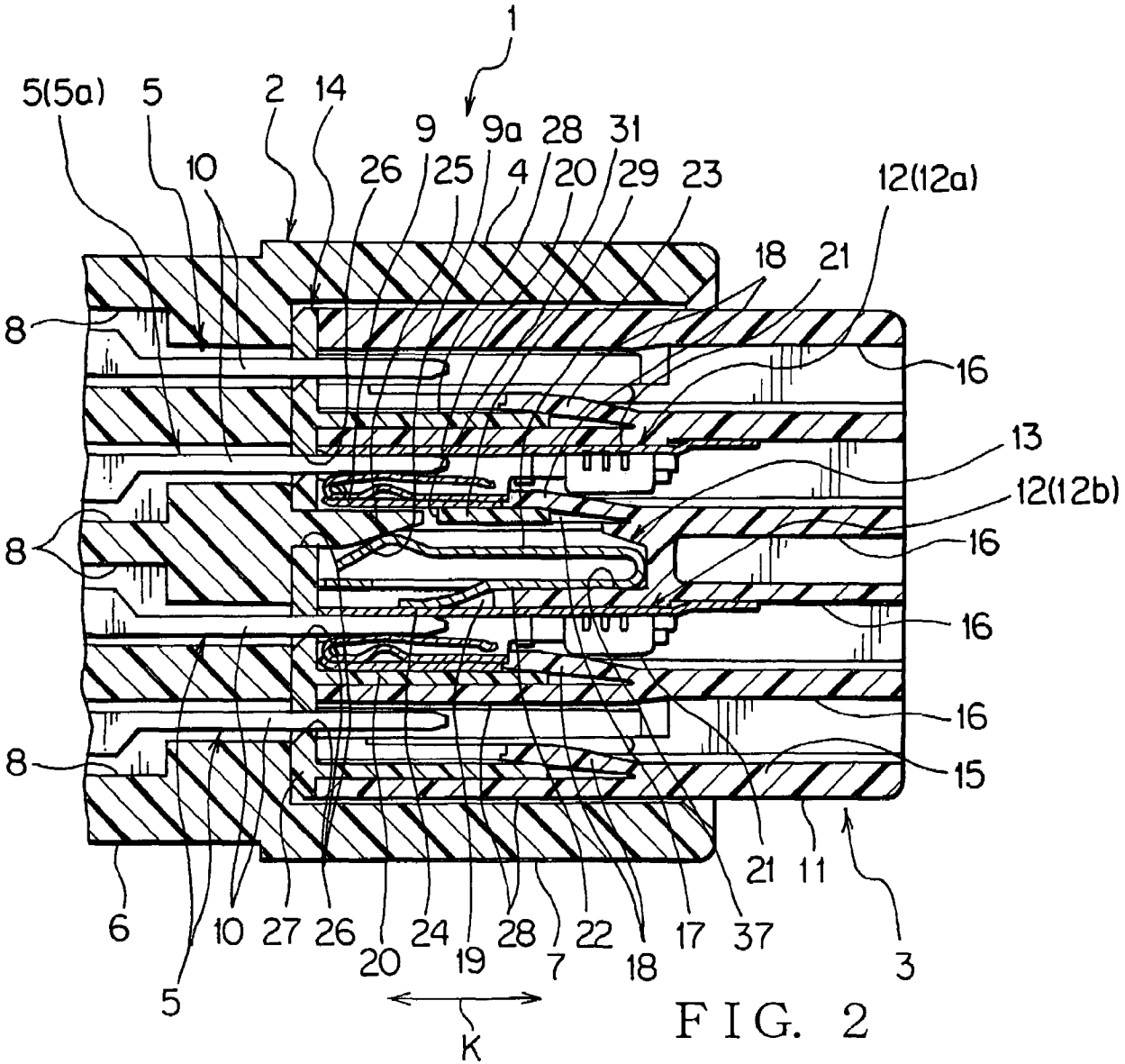
FIG. 2 is a cross sectional view taken along II-II line in FIG. 1.
Figure 3:
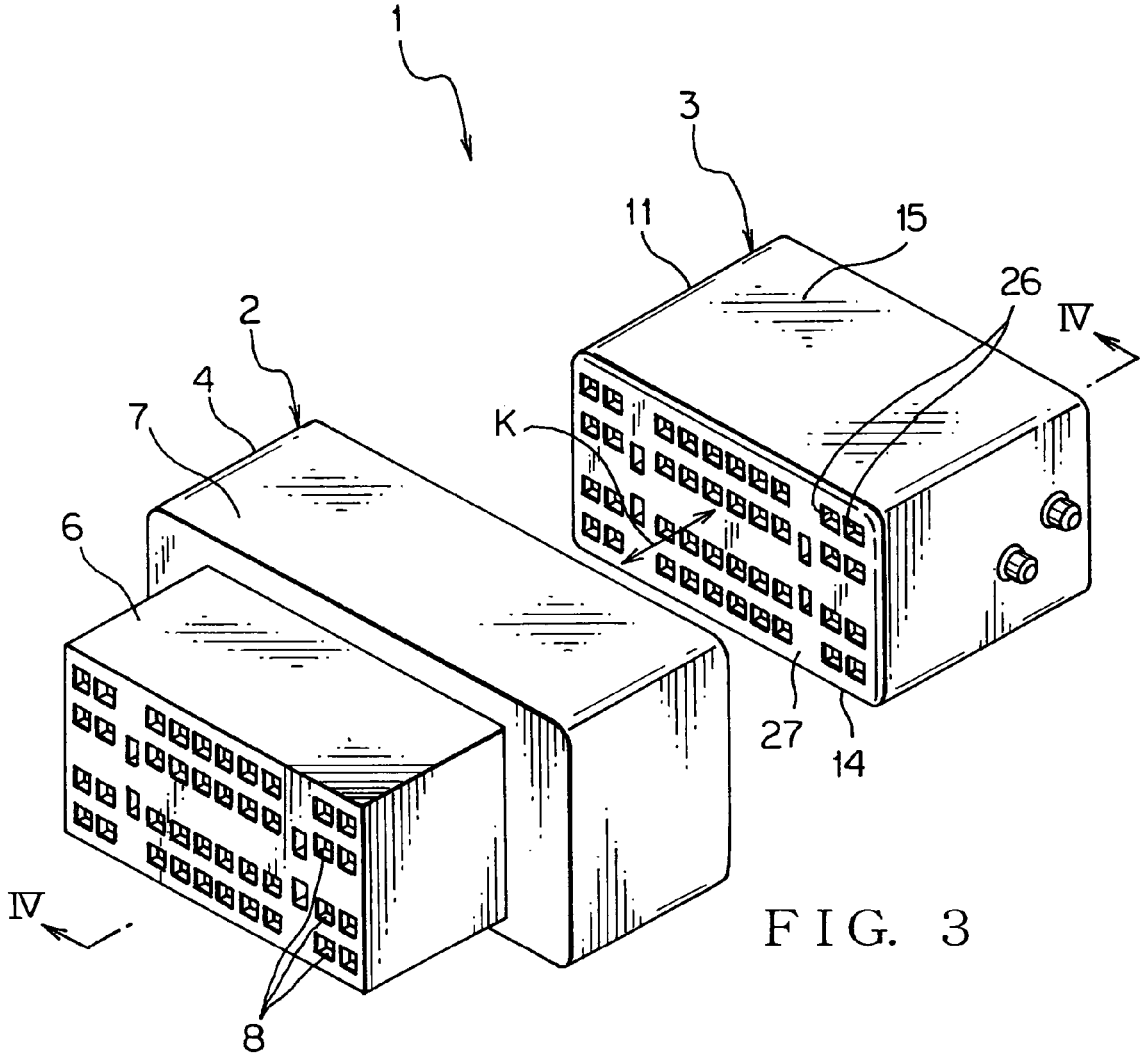
FIG. 3 is a perspective view illustrating a state when the connectors of the connector unit shown in FIG. 1 are separated from each other.

In the following, the preferred embodiments of the present invention will be explained with reference to the attached drawings.

A connector unit 1 composes a wiring harness to be mounted on a motor vehicle and so on, and includes a mating connector 2 and a connector 3 as shown in FIGS. 1-4.

The mating connector 2 includes a mating connector housing 4 and male terminal fittings (hereinafter, male terminals; shown in FIGS. 2 and 4) 5 as mating terminal fittings. The mating connector housing 4 is made of electrically insulating synthetic resin and includes a box-shaped body part 6 and a tube-shaped drum part 7.

Figure 4:
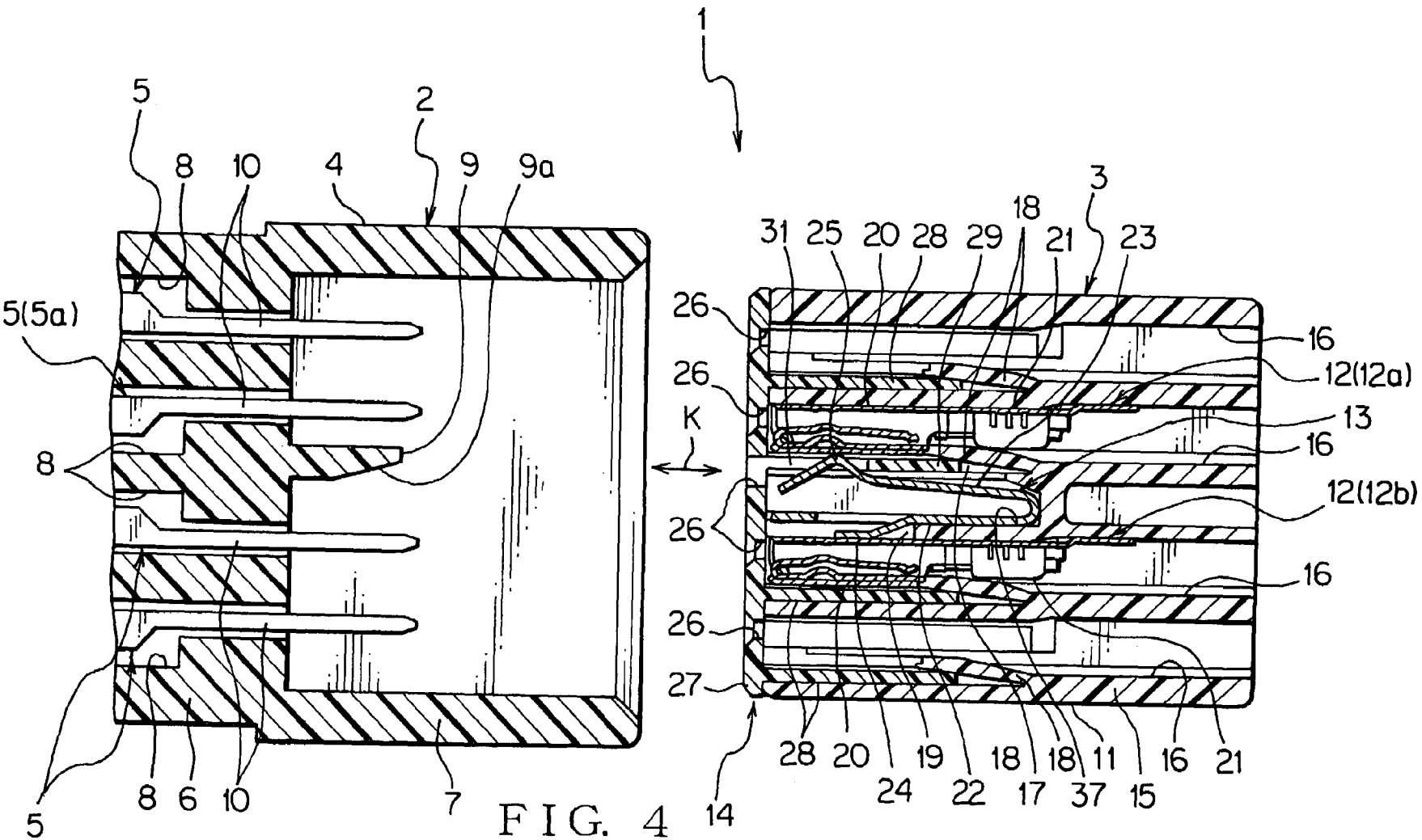
FIG. 4 is a cross sectional view taken along IV-IV line in FIG. 3.

As shown in FIGS. 2 and 4, the body part 6 includes a plurality of terminal-receiving chambers 8, a releasing piece 9 as the releasing part, and a locking part (not shown in the figure). The terminal-receiving chamber 8 is a straight space formed in the body part 6. The terminal-receiving chambers 8 are arranged in parallel to one another.

In an example shown in the figures, the releasing piece 9 is formed integrally with the body part 6. The releasing piece 9 is made of insulating synthetic resin. The releasing piece 9 projects from a surface of the body part 6, said surface facing the connector 3, and extends from said surface toward the connector 3. The releasing piece 9 enters into a bending space 17 of the connector 3 when the connectors 2 and 3 are coupled with each other. The releasing piece 9 is provided with a tapered surface 9*a* that abuts against a resilient contacting piece 23 of a short circuit terminal 13 (explained later on) when the releasing piece 9 enters in a bending space 17. The tapered surface 9*a* is formed inclined with regard to a coupling direction K (shown by an arrow K in FIG. 4) of the connectors 2 and 3 so that the tapered surface 9*a* is gradually tapered as leaving said surface that faces the connector 3.

The coupling direction K means a direction in which the connectors 2 and 3 approach each other when the connectors 2 and 3 are coupled with each other. That is, the coupling direction K is in parallel with a longitudinal direction of the male terminal 5 situated in the mating connector housing 4, a longitudinal direction of the female terminal 12 received in the connector housing 11, and a longitudinal direction of an electric wire attached to the terminals 5 and 12.

When the releasing piece 9 enters in the bending space 17 so that the tapered surface 9*a* abuts against the resilient contacting piece 23 of the short circuit terminal 13, since the tapered surface 9*a* is inclined with regard to the coupling direction K, the releasing piece 9 gradually parts the resilient contacting piece 23 from a female terminal fitting 12 (explained later on) as the other terminal fitting as the connectors 2 and 3 are being coupled with each other.

Since the releasing piece 9 is made of insulating synthetic resin (that is, the mating connector 2 is made of insulating synthetic resin), when the connectors 2 and 3 are completely coupled with each other, the releasing piece 9 parts the resilient contacting piece 23 from the female terminal fitting 12 so as to remove the electrical connection between the short circuit terminal 13 and the female terminal fitting 12. Thus, the releasing piece 9 removes the electrical connection between the female terminal fittings 12.

The locking part fits to a lock-receiving part formed in a connector housing 11 (explained later on) of the connector 3 so as to couple the connector housings 4 and 11 with each other, that is, to couple the connectors 2 and 3 with each other.

Each of a plurality of the male terminals 5 is made of electrically conductive metal. The male terminal 5 is made from sheet metal by stamping and bending. The male terminal 5 integrally includes a bar-shaped electric contact part 10 and an electric wire connecting part (not shown in the figure) continuing to the electric contact part 10. The electric contact part 10 projects from the surface, which faces the connector 3, into the drum part 7 when the male terminal 5 is received in the terminal-receiving chamber 8, that is, when the male terminal 5 is attached to the connector housing 4.

When the connectors 2 and 3 are coupled with each other, the electric contact part 10 enters into a terminal-receiving chamber 16 (explained later on) of the connector 3 so as to be electrically and mechanically connected to an electric contact part 20 of the female terminal fitting 12. The electric wire connecting part is received in the terminal-receiving chamber 8. The electric wire connecting part attaches an electric wire thereto and is electrically connected to a core wire of the electric wire. The male terminal 5 electrically connects the electric wire to the female terminal fitting 12.

One male terminal (i.e. one mating terminal fitting) of a plurality of the male terminals 5 (hereinafter, 5*a*) is connected to a power source and a collision-detecting sensor of an air bag as a high reliability electronic instrument. The male terminal 5*a* supplies signals indicating a collision of a motor vehicle detected by the collision-detecting sensor and electric power from the power source to the gas generator of the air bag through the female terminal fitting 12 and so on.

The high reliability electronic instrument means an instrument, in which a malfunction, for example, due to static electricity occurring when the connectors 2 and 3 are separated from each other must be prevented. That is, the male terminal 5*a* transmits electric power and signals concerning an action of the air bag as the high reliability electronic instrument and is connected to instruments such as a collision-detecting sensor as the high reliability electronic instrument.

As shown in FIGS. 1-4, the connector 3 includes a connector housing 11, female terminal fittings (hereinafter, female terminals; shown in FIGS. 2 and 4) 12, a short circuit terminal 13, and a front holder 14 as a spacer.

The connector housing 11 is made of insulating synthetic resin. The connector housing 11 includes a box-shaped body part 15. The body part 15 includes a plurality of terminal-receiving chambers 16 for receiving the female terminal fittings 12, a receiving part 37, a bending space 17, and a lock-receiving part (not shown in the figure) to which the locking part fits.

The terminal-receiving chamber 16 is a straight space provided in the body part 15 and both ends of the terminal-receiving chamber 16 open on outer surfaces of the body part 15, that is, on outer surfaces of the connector housing 11. A plurality of the terminal-receiving chambers 16 are arranged in parallel to one another.

Each terminal-receiving chamber 16 has a locking piece 18. One end of the locking piece 18 continues to an inner surface of the terminal-receiving chamber 16 and another end of the locking piece 18 is positioned inside the terminal-receiving chamber 16 compared to the one end on a normal state in which the locking piece 18 is not resiliently deformed. The other end of the locking piece 18 can lock an end of an electric contact part 20 (explained later on) of the female terminal 12, said end being situated in the proximity of an electric wire connecting part 21. The locking piece 18 can be resiliently deformed in a direction in which the other end of the locking piece 18 faces from the inside of the terminal-receiving chamber 16 toward the outside of the terminal-receiving chamber 16.

When the female terminal 12 is inserted in the terminal-receiving chamber 16, the locking piece 18 is pressed by the electric contact part 20 of the female terminal 12, so that the other end of the locking piece 18 faces the outside of the terminal-receiving chamber 16 so as to be resiliently deformed in the bending space 17. When the electric contact part 20 of the female terminal 12 climbs over the other end of the locking piece 18, the other end of the locking piece 18 is again situated in the terminal-receiving chamber 16 (i.e. returned to the normal state) due to resilient restoring force, so that the other end of the locking piece 18 locks the end of the electric contact part 20 of the female terminal 12. Thus, the locking piece 18 prevents the female terminal 12 from coming out from the terminal-receiving chamber 16.

The receiving part 37 is a straight space provided in the body part 15. The receiving part 37 is arranged between the two terminal-receiving chambers 16 adjacent to each other and opens on a surface of the body part 15, said surface facing the mating connector 2. The receiving part 37 is adjacent to a locking piece 18 of one of the two terminal-receiving chambers 16 adjacent to each other.

The terminal-receiving chambers 16 each has a bending space 17. The bending space 17 is a part of a space in the terminal-receiving chamber 16 and positions the locking piece 18. The locking piece 18 is once resiliently deformed in the bending space 17 when the female terminal 12 is inserted. The bending space 17 formed in the connector housing 11 is a space in which the locking piece 18 is positioned when the locking piece 18 is resiliently deformed, that is, a space in which the locking piece 18 is allowed to be resiliently deformed.

The receiving part 37 is communicated to one of the two terminal-receiving chambers 16 that position the receiving part 37 therebetween by the bending space 17. The bending space 17 allows a resilient contacting piece 23 (explained later on) of the short circuit terminal 13 to pass therethrough. A communication hole 19 is provided between the receiving part 37 and the other terminal receiving chambers 16 of the two terminal receiving chambers 16 that position the receiving part 37 therebetween so as to communicate the receiving part 37 and the other terminal receiving chamber 16. The communication hole 19 allows a contacting piece 24 (explained later on) of the short circuit terminal 13 to pass therethrough.

When the locking part fits to the lock-receiving part so that the connector housing 11 is coupled with the mating connector housing 4, the connector housing 11 enters into the drum part 7 of the mating connector housing 4.

The female terminal 12 is made from conductive sheet metal by stamping and bending. The female terminal 12 integrally includes a tube-shaped electric contact part 20 and an electric wire connection part 21 continuing to the electric contact part 20 and extends straight. The electric contact part 10 of the male terminal 5 enters into the inside of the electric contact part 20, so that the electric contact part 20 is electrically and mechanically connected to the male terminal 5. The electric wire connection part 21 attaches an electric wire (not shown in the figure) so as to be electrically connected to a core wire of the electric wire. When the connectors 2 and 3 are coupled with each other, the electric contact part 10 of the male terminal 5 enters into the electric contact part 20 so as to electrically connect the electric wire to the male terminal 5.

One female terminal 12 (hereinafter, 12*a*), which is electrically connected to one male terminal 5*a* connected to the power source and the collision detecting sensor of the air bag, of the two female terminals 12 received in the respective two terminal-receiving chambers 16 that position the receiving part 37 therebetween is connected to the gas generator (i.e. instrument) of the air bag as a high reliability electronic instrument. Another female terminal 12 (hereinafter, 12*b*) is connected to the ground. The one female terminal 12*a* corresponds to one terminal fitting of the two terminal fittings, while the other female terminal 12*b* corresponds to another terminal fitting of the two terminal fittings.

Figure 5:
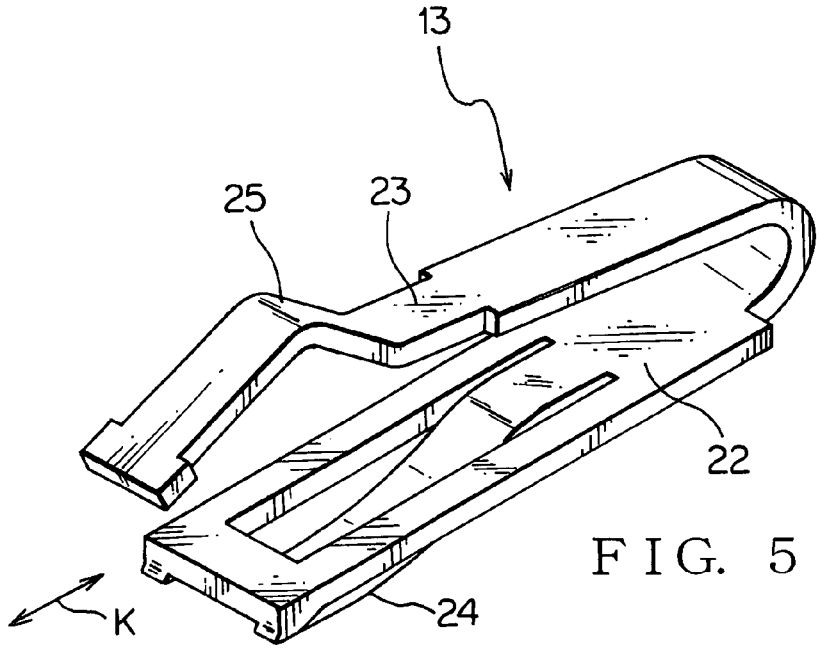
FIG. 5 is a perspective view illustrating a short circuit terminal of the connector shown in FIG. 1.

The short circuit terminal 13 is made from conductive sheet metal by stamping and bending. As shown in FIG. 5, the short circuit terminal 13 integrally includes a fixing part 22, a resilient contacting piece 23, and contacting piece 24.

The fixing part 22 is formed in a rectangular belt-shape in its plan view. The fixing part 22 is received in the bending space 17 and fixed to an inner surface of the bending space 17. Thus, the fixing part 22 is arranged between the two female terminals 12*a* and 12*b*.

One end of the resilient contacting piece 23 continues to an end of the fixing part 22, said end being on the side situated away from the mating connector 2, and the resilient contacting piece 23 is formed in a belt-shape being bent toward the mating connector 2 from the end. Another end of the resilient contacting piece 23 is provided with a contact 25 for coming in contact with the one female terminal 12*a*. The contact 25 is positioned at the most outside of the short circuit terminal 13 compared to other portions of the resilient contacting piece 23.

The resilient contacting piece 23 is set resilient in such a way that the contact 25 approaches and leaves the one female terminal 12*a*. When the contact 25 comes in contact with the one female terminal 12*a*, the contact 25 is slightly deformed resiliently in a direction in which the contact 25 leaves the one female terminal 12*a*. Thus, to come in resilient contact means to come in contact being deformed resiliently. That is, the resilient contacting piece 23 comes in resilient contact with the one female terminal 12*a*. When the short circuit terminal 13 is received in the receiving part 37, the resilient contacting piece 23 passes through the bending space 17 and comes in resilient contact with the one female terminal 12*a*.

A portion of the fixing part 22 is cut and broken toward the outside of the short circuit terminal 13, thereby forming the contacting piece 24. The contacting piece 24 is inclined with regard to the coupling direction K toward the outside of the short circuit terminal 13 from the fixing part 22 as the contacting piece 24 approaches the mating connector 2. When the short circuit terminal 13 is received in the receiving part 37, the contacting piece 24 passes through the communication hole 19 and comes in contact with the other female terminal 12*b*. Thus, in an example shown in the figures, the contacting piece 24 comes in contact with the other female terminal 12*b* without being deformed. The resilient contacting piece 23 and the contacting piece 24 are situated putting the fixing part 22 therebetween, that is, positioning the fixing part 22 therebetween.

The short circuit terminal 13 is inserted into the receiving part 37 through an opening formed on a surface of the receiving part 37, said surface facing the mating connector 2. At that time, the other end of the resilient contacting piece 23 is positioned nearer to the mating connector 2 than the one end is. When the female terminals 12*a* and 12*b* are inserted in the respective two terminal receiving chambers 16, the resilient contacting piece 23 comes in resilient contact with the one 25 female terminal 12*a* and the contacting piece 24 comes in contact with the other female terminal 12*b*. Thus, the short circuit terminal 13 electrically connects the two female terminals 12*a* and 12*b* to each other when the contacting pieces 23 and 24 come in contact with the female terminals 12*a* and 12*b*, respectively.

Figure 6:
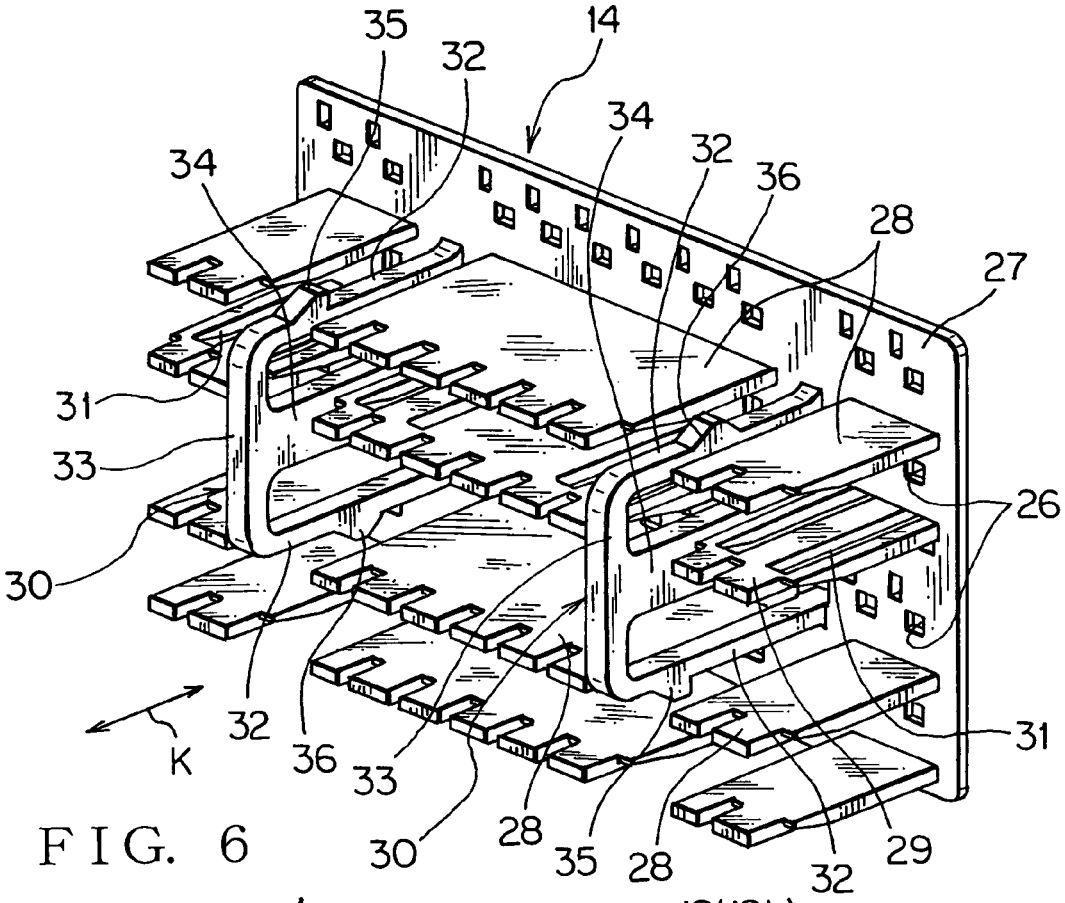
FIG. 6 is a perspective view illustrating a front holder of the connector shown in FIG. 1.

As shown in FIG. 6, the front holder 14 includes: a flat plate 27 having a plurality of holes 26; deformation-restricting piece 28; restricting piece 29 as the restricting part; and a locking part 30. The flat plate 27 is placed on a surface of the body part 15 of the connector housing 11, said surface facing the mating connector 2. The holes 26 formed in the flat plate 27 communicate with the terminal-receiving chamber 16 and the receiving part 37. That is, the holes 26 are arranged with the terminal-receiving chamber 16 and the receiving part 37 in the coupling direction K.

The deformation-restricting piece 28 is formed in a belt-shape and rises up from the flat plate 27. When the flat plate 27 is placed on the surface of the body part 15 of the connector housing 11, the deformation-restricting piece 28 enters into the terminal-receiving chamber 16. When an end part of the deformation-restricting piece 28 is positioned between an inner surface of the terminal-receiving chamber 16 and the locking piece 18, said end part being on the side situation away from the flat plate 27, the deformation-restricting piece 28 indirectly prevents the locking piece 18 from being resiliently deformed, that is, indirectly prevents the female terminal 12 from coming out from the terminal-receiving chamber 16. On the other hand, when the end part of the deformation-restricting piece 28 is not positioned between an inner surface of the terminal-receiving chamber 16 and the locking piece 18, the deformation-restricting piece 28 allows the locking piece 18 to be resiliently deformed, that is, allows the female terminal 12 to enter into the terminal-receiving chamber 16.

The restricting piece 29 is formed in a belt-shape and rises up from the flat plate 27. When the flat plate 27 is placed on the surface of the body part 15 of the connector housing 11, the restricting piece 29 enters into the bending space 17. When an end part of the restricting piece 29 is placed on the locking piece 18 of a terminal-receiving chamber 16 receiving the one female terminal 12*a* in a direction crossing the coupling direction K, said end part being on the side situated away from the flat plate 27, the restricting piece 29 indirectly prevents the locking piece 18 from being resiliently deformed, that is, indirectly prevents the female terminal 12*a* from coming out from the terminal-receiving chamber 16. On the other hand, when the end part of the restricting piece 29 is not placed on the locking piece 18 of a terminal-receiving chamber 16 receiving the one female terminal 12*a* in a direction crossing the coupling direction K, the restricting piece 29 allows the locking piece 18 to be resiliently deformed, that is, allows the female terminal 12*a* to enter into the terminal-receiving chamber 16.

Thus, when the front holder 14 is attached to the body part 15 of the connector housing 11 at a full locking position, the deformation-restricting piece 28 and the restricting piece 29 prevents the locking piece 18 from being resiliently deformed.

The restricting piece 29 is provided with a through hole 31. The through hole 31 passes the resilient contacting piece 23 of the short circuit terminal 13 received in the receiving part 37 therethrough so as to allow the resilient contacting piece 23 to come in contact with the one female terminal 12*a*.

In an example shown in the figure, two locking parts 30 are provided. Each locking part 30 includes: a pair of rising-up rods 32 rising up from the flat plate 27 in the same direction as that of the restricting pieces 28 and 29; connecting rod 33; support rod 34; provisional locking projection 35; and full locking projection 36. The rising-up rods 32 are formed in a straight rod-shape and arranged in parallel to one another.

The connecting rod 33 is formed in a straight rod-shape and connects ends part of the pair of the rising-up rods 32, said end part being on the side situated away from the flat plate 27. The support rod 34 rises up from the flat plate 27 in the same direction as that of the restricting pieces 28 and 29 and continues to the connecting rod 33. The provisional locking projection 35 projects from one rising-up rod 32 of the pair of the rising-up rods 32 and locks a lock-receiving part of the body part 15 of the connector housing 11. The full locking projection 36 projects from another rising-up rod 32 of the pair of the rising-up rods 32 and locks a lock-receiving part of the body part 15 of the connector housing 11. The full locking projection 36 is arranged nearer to the flat plate 27 than the provisional locking projection 35 is.

The front holder 14 is attached to the body part 15 of the connector housing 11 at both a provisional locking position at which the provisional locking projection 35 locks the lock-receiving part and a full locking position at which the full locking projection 36 locks the lock-receiving part. At that time, the flat plate 27 of the front holder 14 is arranged in parallel with the surface of the body part 15 of the connector housing 11.

Figure 7:
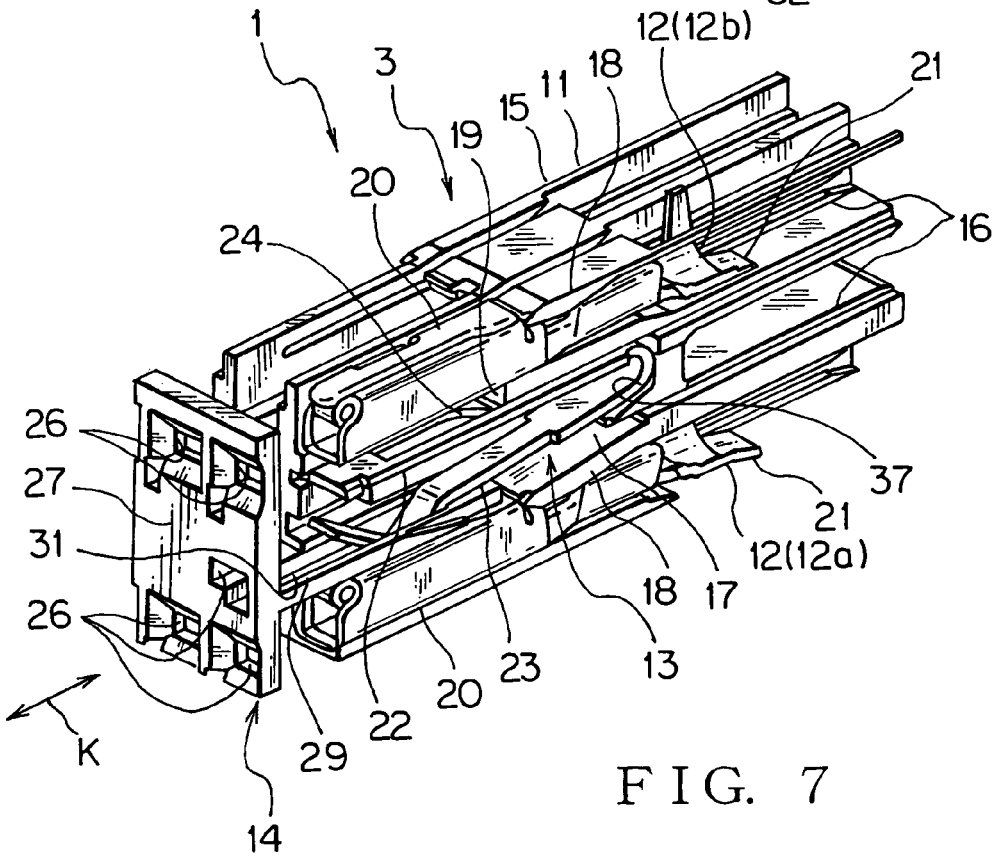
FIG. 7 is a perspective view illustrating a state when the front holder shown in FIG. 6 is positioned at a provisional locking position.
Figure 8:
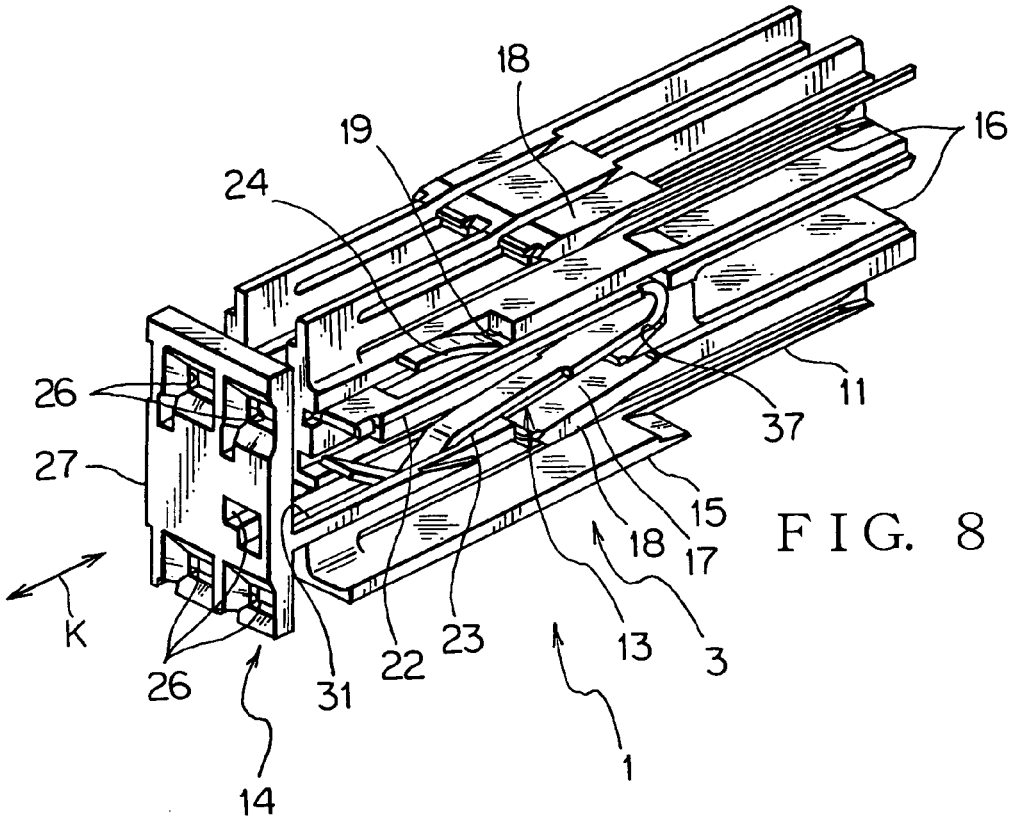
FIG. 8 is another perspective view illustrating a state when the front holder shown in FIG. 6 is positioned at a provisional locking position.

As shown in FIGS. 7 and 8, as for the front holder 14, at the provisional locking position, the flat plate 27 is spaced from the surface of the body part 15 of the connector housing 11, the end part of the deformation-restricting piece 28 is not positioned between the inner surface of the terminal-receiving chamber 16 and the locking piece 18, and the end part of the restricting piece 29 does not abut on the locking piece 18. That is, as for the front holder 14, at the provisional locking position, the deformation-restricting piece 28 and the restricting piece 29 allow the locking piece 18 to be resiliently deformed so as to allow the female terminals 12, 12*a* and 12*b* to enter into or come out from the terminal-receiving chamber 16.

As shown in FIGS. 2 and 4, as for the front holder 14, at the full locking position, the flat plate 27 abuts on the surface of the body part 15 of the connector housing 11, the end part of the deformation-restricting piece 28 is positioned between the inner surface of the terminal-receiving chamber 16 and the locking piece 18, and the end part of the restricting piece 29 abuts on the locking piece 18. That is, as for the front holder 14, at the full locking position, the deformation-restricting piece 28 and the restricting piece 29 prevent the locking piece 18 from being resiliently deformed so as to prevent the female terminals 12, 12*a* and 12*b* from entering into or coming out from the terminal-receiving chamber 16. Thus, as for the connector 3, both the locking piece 18 and the front holder 14 lock (doubly lock) the female terminals 12, 12*a* and 12*b*.

Figure 9A:
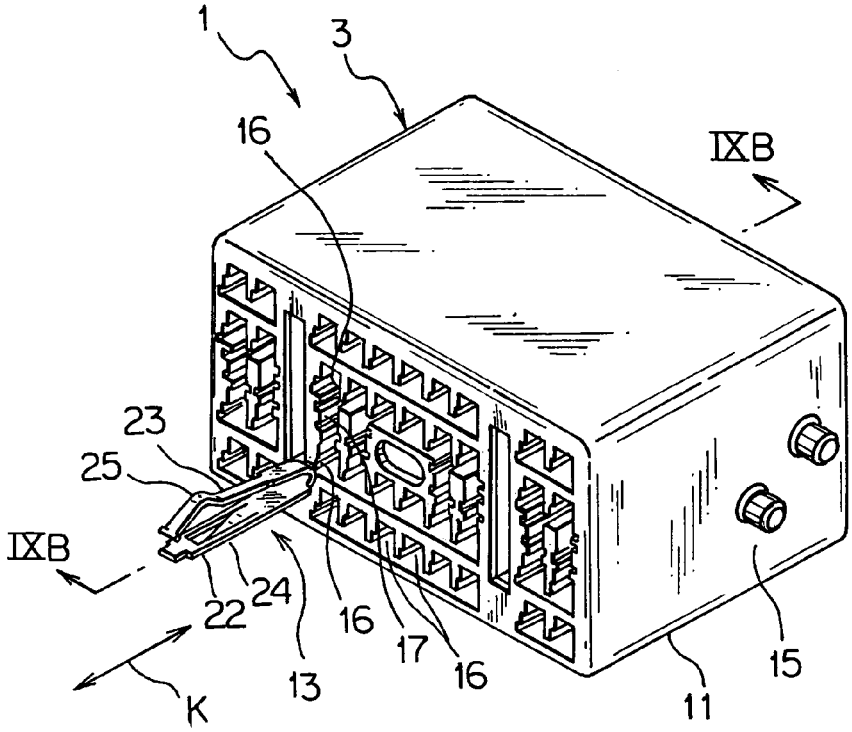
FIG. 9A is a perspective view illustrating the connector housing and short circuit terminal of the connector unit shown in FIG. 1.
Figure 9B:
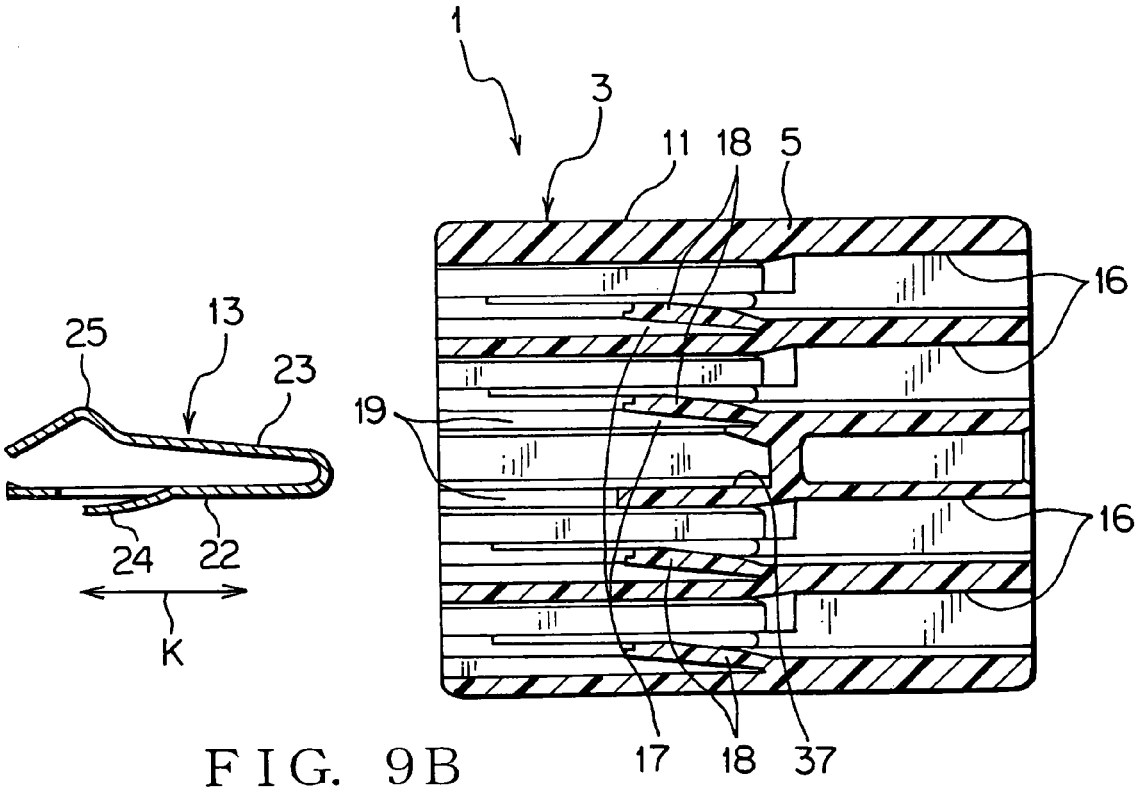
FIG. 9B is a cross sectional view taken along IXB-IXB line in FIG. 9A.
Figure 10A:
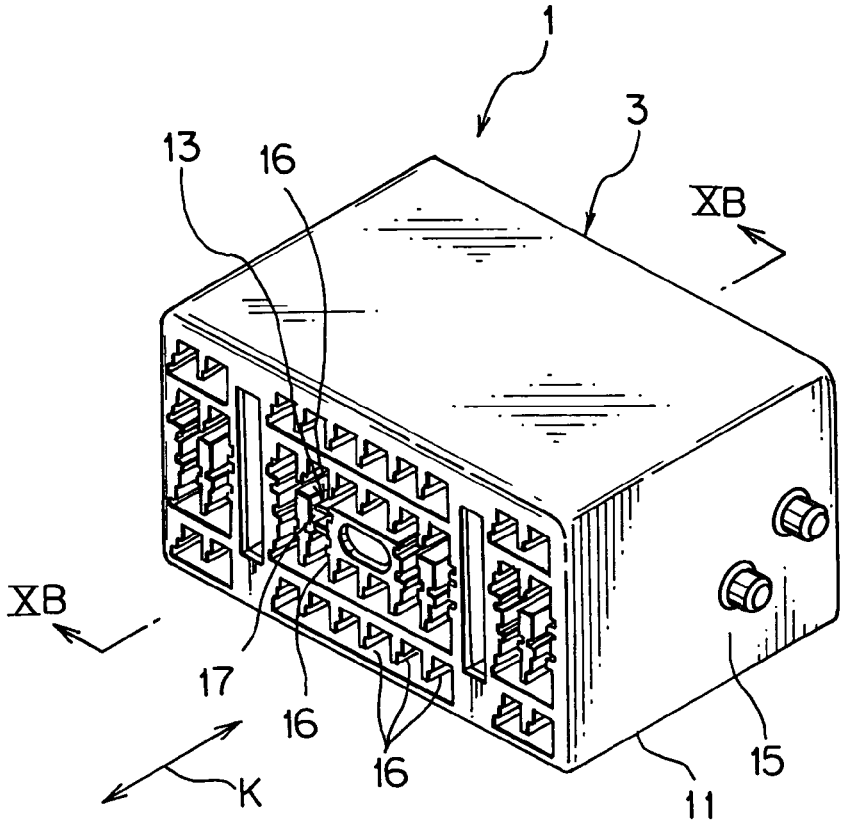
FIG. 10A is a perspective view illustrating a state when the short circuit terminal shown in FIG. 9 is received in the connector housing.
Figure 10B:
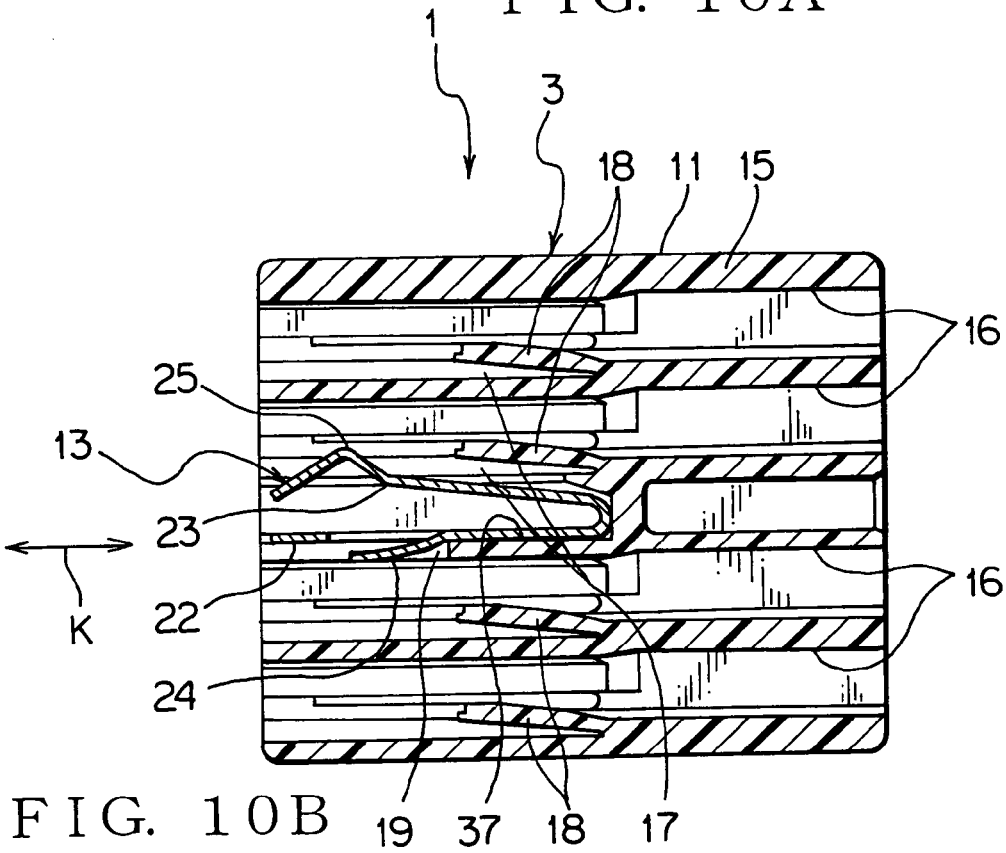
FIG. 10 is a cross sectional view taken along XB-XB line in FIG. 10A.

The connector 3 is assembled in the following manner. First, as shown in FIGS. 9A and 9B, the short circuit terminal 13 is allowed to face an opening of the receiving part 37 on the surface of the body part 15 of the connector housing 11. Thereafter, the short circuit terminal 13 is inserted into the receiving part 37 and received in the receiving part 37 as shown in FIGS. 10A and 10B. At that time, the other end of the resilient contacting piece 23 is arranged nearer to the surface of the body part 15 of the connector housing 11 than the one end thereof is.

Figure 11A:
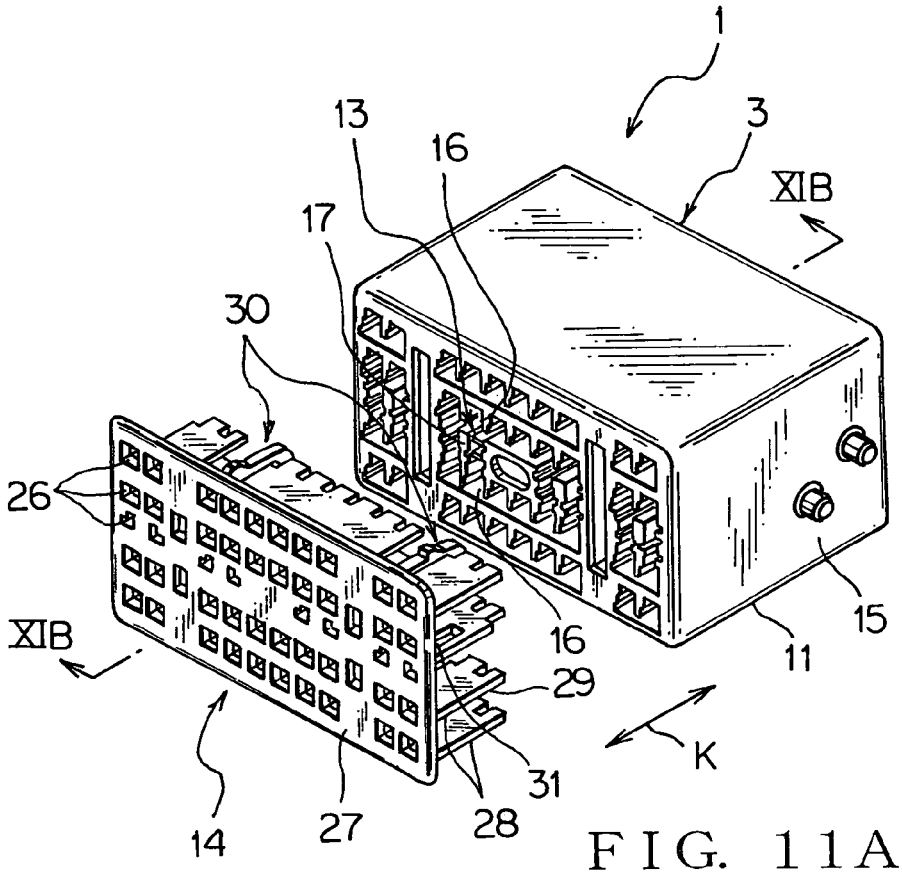
FIG. 11A is a perspective view illustrating the connector housing shown in FIG. 10A and a front holder.
Figure 11B:
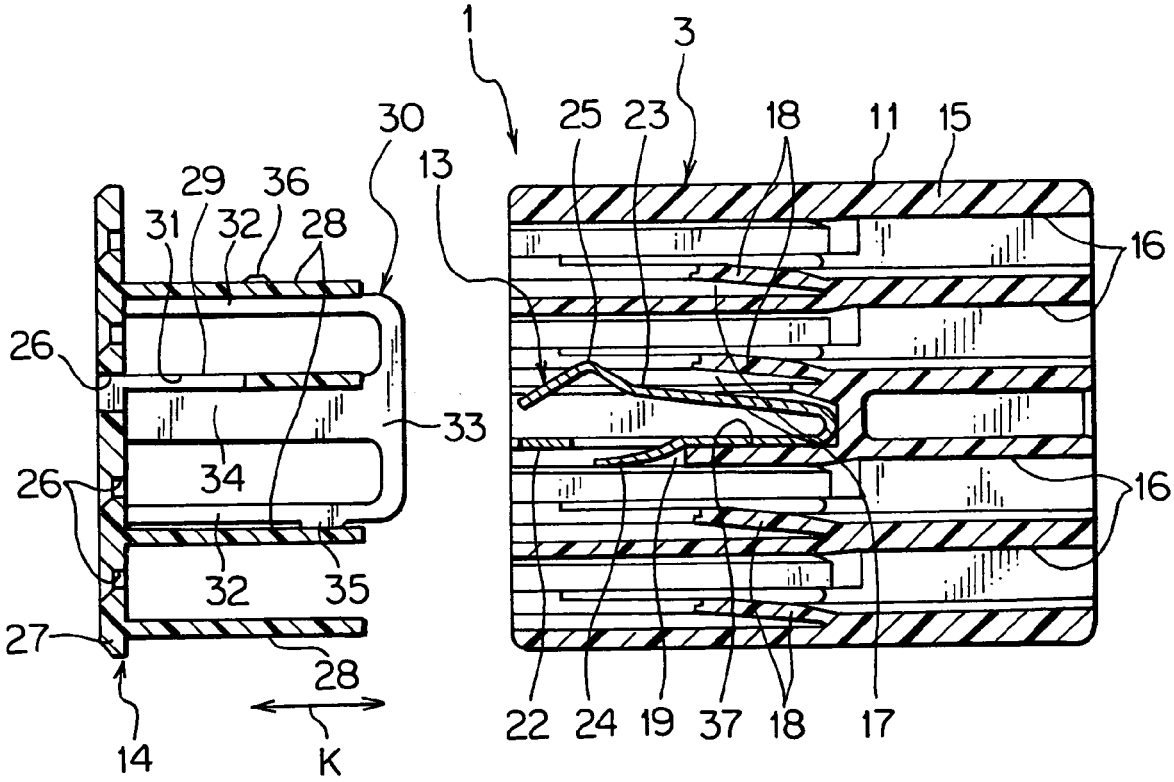
FIG. 11B is a cross sectional view taken along XIB-XIB line in FIG. 11A.
Figure 12A:
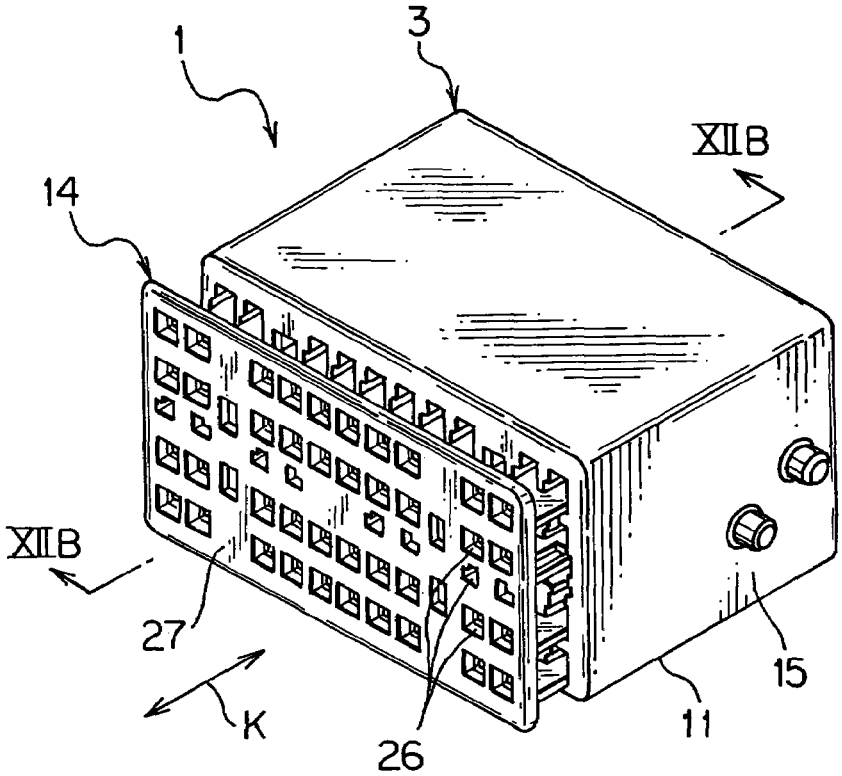
FIG. 12A is a perspective view illustrating a state when the front holder shown in FIG. 11A is positioned at a provisional locking position.
Figure 12B:
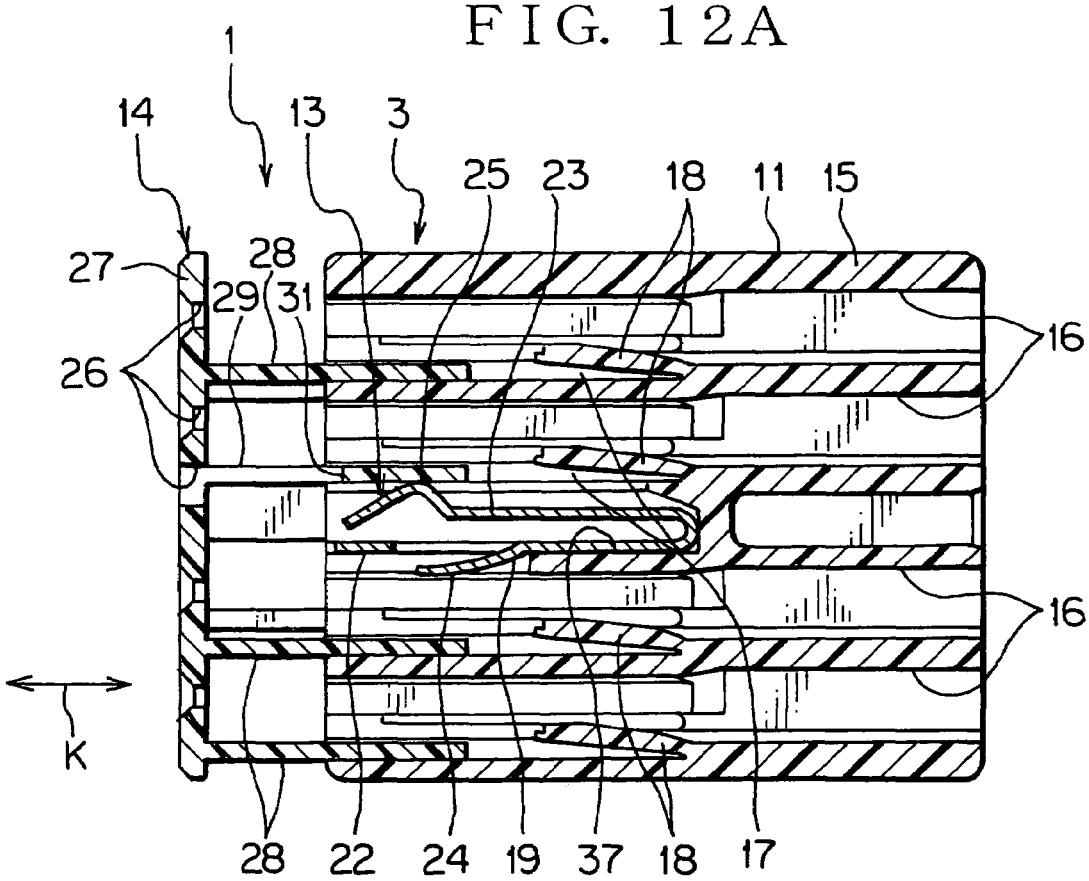
FIG. 12B is a cross sectional view taken along XIIB-XIIB line in FIG. 12A.

Then, as shown in FIGS. 11A and 11B, the front holder 14 is arranged in such a way that the restricting pieces 28 and 29 face openings of the terminal-receiving chamber 16 and the receiving part 37, respectively. Thereafter, the restricting pieces 28 and 29 are inserted into the terminal-receiving chamber 16 and the receiving part 37, respectively, so as to allow the provisional locking projection 35 to lock the lock-receiving part. As a result, as shown in FIGS. 12A and 12B, the front holder 14 is positioned at the provisional locking position.

Figure 13A:
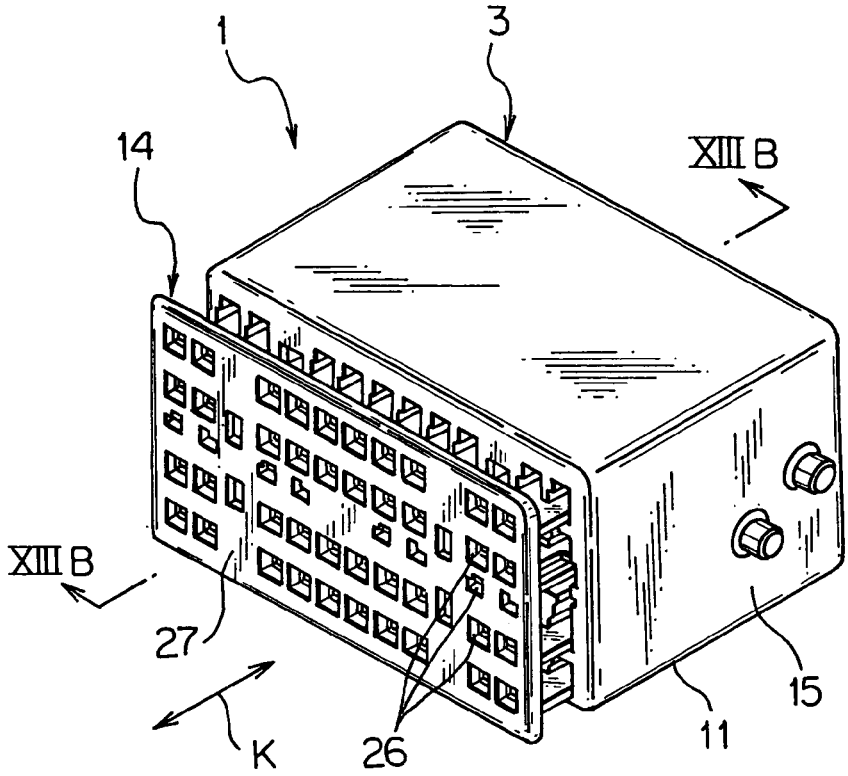
FIG. 13A is a perspective view illustrating a state when a female terminal is received in the connector housing shown in FIG. 12A.
Figure 13B:
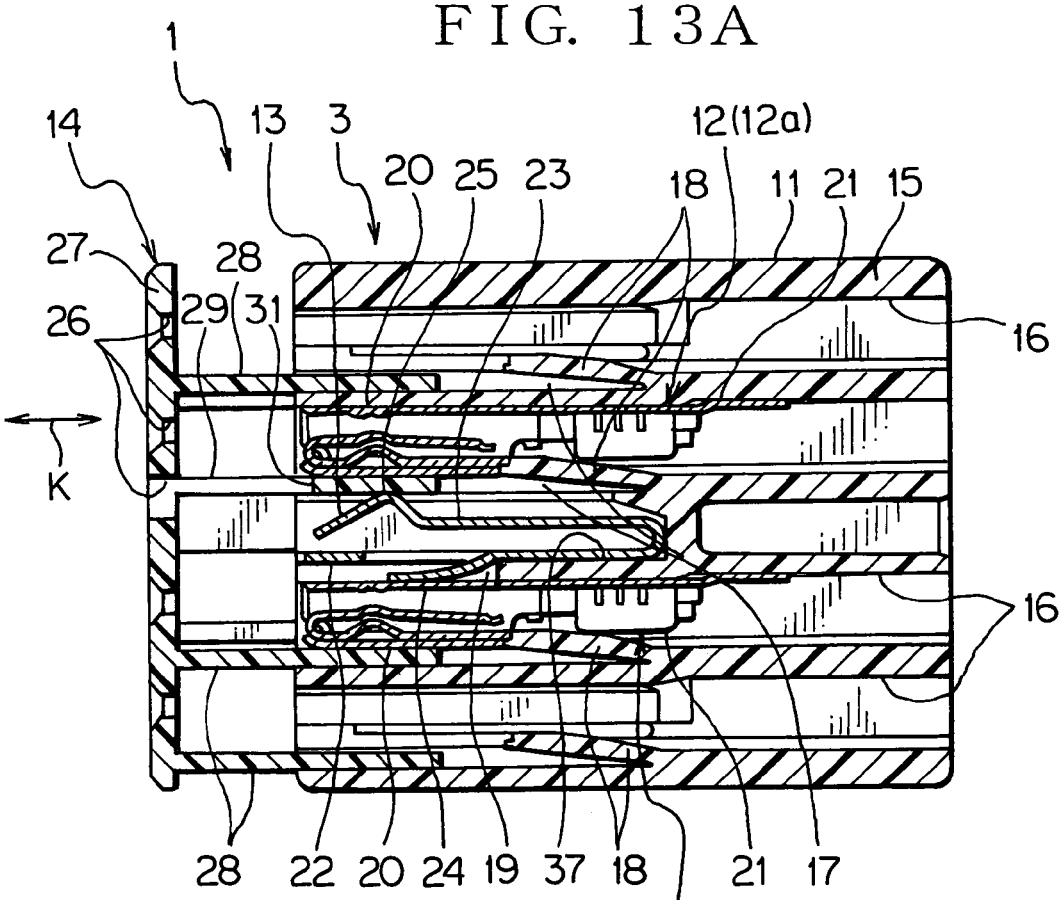
FIG. 13B is a cross sectional view taken along XIIIB-XIIIB line in FIG. 13A.

Then, the female terminals 12, 12*a* and 12*b*, to each of which an electric wire is attached, are inserted into the terminal-receiving chambers 16 of the body part 15 of the connector housing 11. The locking piece 18 is once resiliently deformed in the bending space 17 and thereafter, the locking piece 18 locks the ends of the electric contact parts 20 of the female terminals 12, 12*a* and 12*b*. As shown in FIGS. 13A and 13B, the female terminals 12, 12*a* and 12*b* are received in the terminal-receiving chambers 16.

Figure 14A:
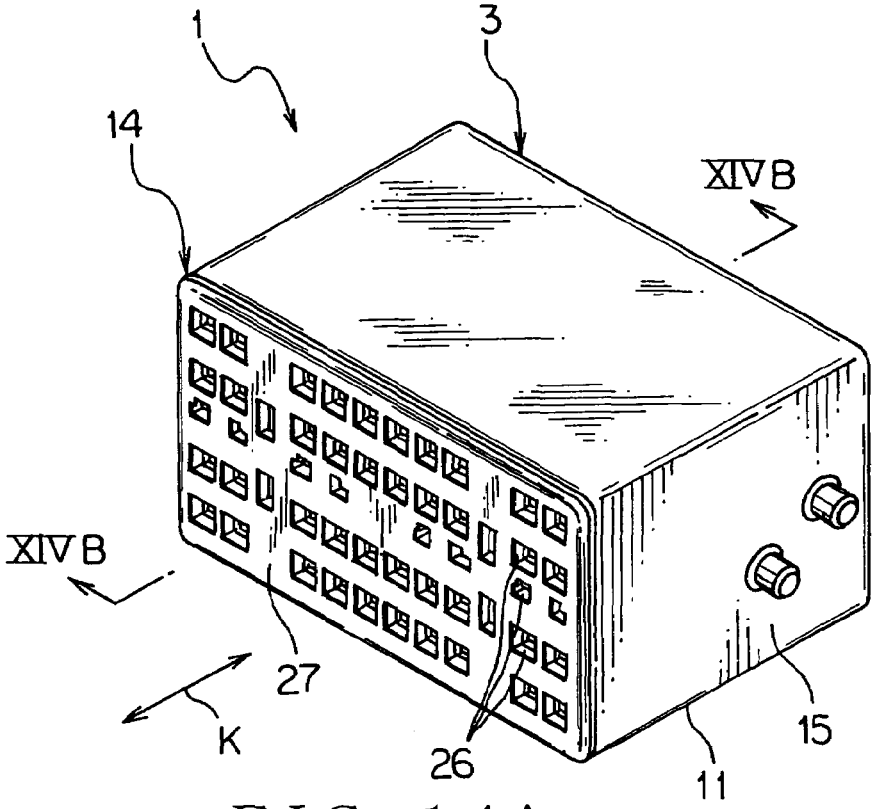
FIG. 14A is a perspective view illustrating a state when the front holder shown in FIG. 13A is positioned at a full locking position.
Figure 14B:
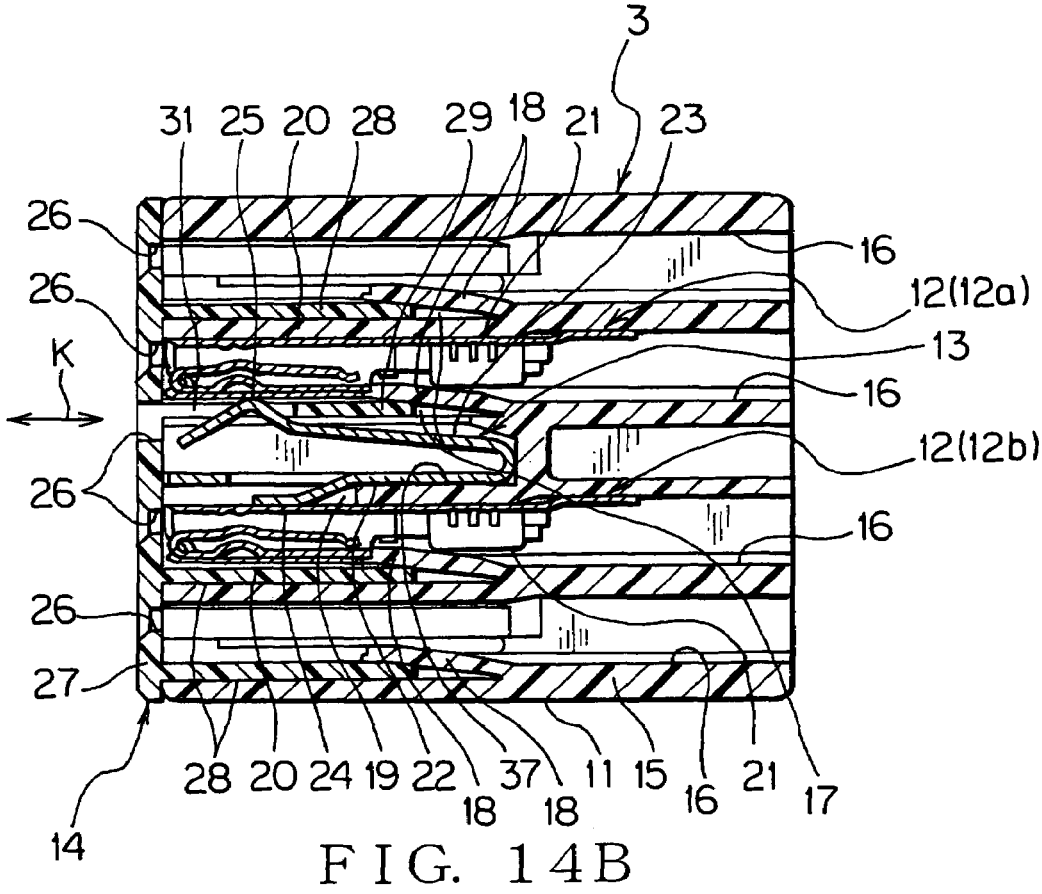
FIG. 14B is a cross sectional view taken along XIVB-XIVB line in FIG. 14A.

Thereafter, the flat plate 27 of the front holder 14 is pressed toward the surface of the body part 15 of the connector housing 11 so as to allow the full locking projection 36 to lock the lock-receiving part so that the front holder 14 is positioned at the full locking position. Then, as shown in FIGS. 14A and 14B, the resilient contacting piece 23 passes through the bending space 17 and comes in resilient contact with the one female terminal 12*a*, while the contacting piece 24 passes through the communication hole 19 and comes in contact with the other female terminal 12*b*. Thus, the short circuit terminal 13 is received in the receiving part 37 and electrically connects the two female terminals 12*a* and 12*b* to each other.

The connector 3 thus assembled is coupled with the mating connector 2. As shown in FIG. 2, when the connector 3 is coupled with the mating connector 2, the releasing piece 9 removes the electrical connection between the pair of the female terminals 12*a* and 12*b* attained by the short circuit terminal 13 and the male terminal 5 is electrically connected to the female terminals 12*a* and 12*b*. Thus, the connector unit 1 electrically connects the instruments of the air bag as a high reliability electronic instrument to each other.

In the connector unit 1, when the connectors 2 and 3 are separated from each other, before the electrical connection between the male terminal 5 and the female terminals 12*a*, 12*b* is removed, the releasing piece 9 does not interfere with the resilient contacting piece 23 and the resilient contacting piece 23 electrically connects the two female terminals 12*a* and 12*b* to each other. Therefore, when the connectors 2 and 3 are separated from each other, the connector unit 1 guides static electricity generated due to friction between the male terminal 5 and the one female terminal 12*a* to the ground without transmitting it to the instrument such as the gas generator of the air bag. Thus, the connector unit 1 prevents the air bag as a high reliability electronic instrument from malfunctioning particularly when the connectors 2 and 3 are separated from each other.

In the preferred embodiment, since the resilient contacting piece 23 of the short circuit terminal 13 is situated in the bending space 17 of the locking piece 18, therefore it is not necessary to provide an exclusive space for the resilient contacting piece 23 of the short circuit terminal 13 within the connector housing 11 and therefore, the connector 3 can be made compact.

Since the short circuit terminal 13 has only one resilient contacting piece 23, therefore the connection between the two terminal fittings 12*a* and 12*b* attained by the short circuit terminal 13 can be removed when the connectors 2 and 3 are coupled with each other only by providing the mating connector 2 with the releasing piece 9 for parting the resilient contacting piece 23 from the female terminal 12*a*. Therefore, it is possible to restrict force that presses the connectors 2 and 3 in a direction in which the connectors 2 and 3 approach each other when the connectors 2 and 3 are coupled with each other in comparison with a case in which the releasing piece 9 for pressing both the contacting pieces 23 and 24 is provided. Therefore, the connector 3 can be easily coupled with the mating connector 2 with a small insertion force.

Since the restricting piece 29 of the front holder 14 is provided with the through hole 31 which passes the resilient contacting piece 23 of the short circuit terminal 13 therethrough, therefore interference between the restricting piece 29 and the short circuit terminal 13 can be prevented from occurring and the short circuit terminal 13 can securely connect the female terminals 12*a* and 12*b* to each other. The connector 3 can be prevented from being enlarged.

Since the short circuit terminal 13 is arranged between the two female terminals 12*a* and 12*b*, and the resilient contacting piece 23 of the short circuit terminal 13 is allowed to come in contact with the female terminal 12*a* through the bending space 17, therefore a space for setting the female terminals 12*a* and 12*b* can be small in comparison with a case in which the short circuit terminal 13 is placed overlapping with the two female terminals 12 *a* and 12*b*. Therefore, the connector 3 can be prevented from being enlarged.

Since the connector unit 1 includes the connector 3 as described above, therefore the connector unit 1 can be compact.

Since the mating connector 2 includes the releasing piece 9 which parts the resilient contacting piece 23 away from the female terminal 12*a* , therefore only by coupling the connectors 2 and 3 with each other, the connection between the two female terminals 12*a* and 12*b* achieved by the short circuit terminal 13 can be removed. Therefore, operation characteristic of the connector unit 1 can be improved. Since the releasing piece 9 enters into the bending space 17, therefore it is not necessary to provide an exclusive space for receiving the releasing piece 9. Therefore, the connector unit 1 can be prevented from being enlarged.

Figure 15:
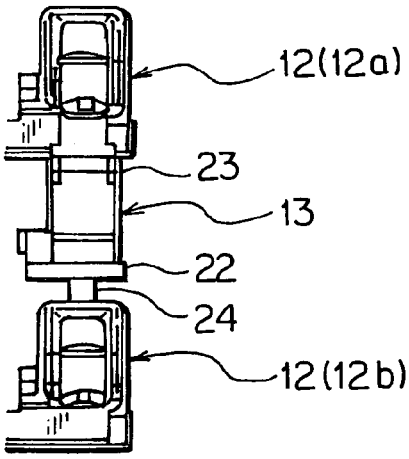
FIG. 15 is a view illustrating a positional relation between female terminals and a short circuit terminal according to the present invention.
Figure 17:
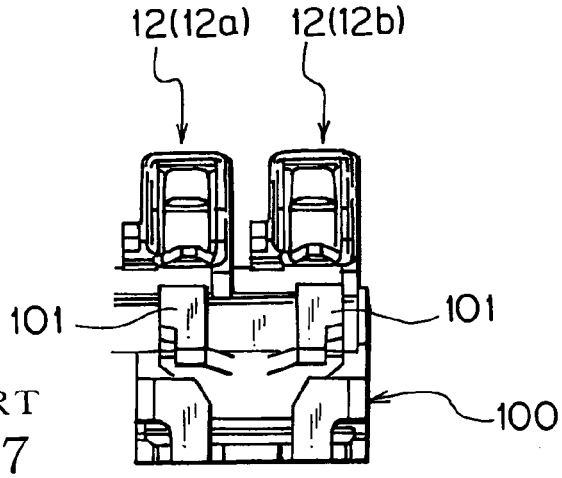
PRIOR ART FIG. 17
FIG. 17 is a view illustrating a positional relation between female terminals and a conventional short circuit terminal as a comparative example.

The effects of the connector unit 1 and the connector 3 according to the preferred embodiment of the present invention is analyzed. The results are shown in FIGS. 15 and 17. FIG. 15 schematically shows a positional relation between the short circuit terminal 13 of the connector 3 in the connector unit 1 and the two female terminals 12*a* and 12*b* to be connected to each other by the short circuit terminal 13 according to the preferred embodiment of the present invention.

Figure 16:
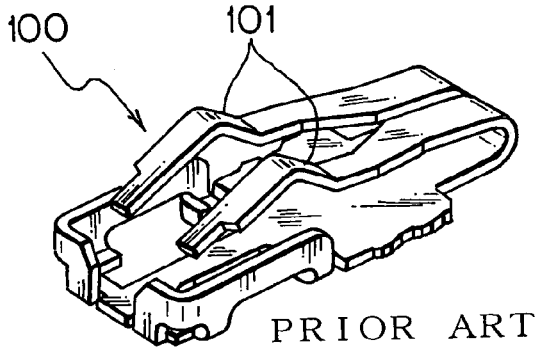
PRIOR ART FIG. 16
FIG. 16 is a perspective view illustrating of a conventional short circuit terminal as a comparative example.

FIG. 17 (comparative example) schematically shows a positional relation between a conventional short circuit terminal 100 and two female terminals 12*a* and 12*b* to be connected to each other by the conventional short circuit terminal 100 in a case in which the conventional short circuit terminal 100 shown in FIG. 16 is used. The conventional short circuit terminal 100 shown in FIG. 16 includes a pair of resilient contacting pieces 101. In FIG. 17, each resilient contacting piece 101 is not arranged between the two female terminals 12*a* and 12*b*, but arranged at a position where each resilient contacting piece 101 overlaps with the female terminal 12*a* or 12*b*.

FIGS. 15 and 17 clearly reveal that according to the present invention (FIG. 15) the two female terminals 12*a* and 12*b* can be electrically connected to each other by using a half of a space required in the comparative example (FIG. 17).

In the preferred embodiment described above, the short circuit terminal 13 electrically connects the two female terminals 12*a* and 12*b* to each other. However, instead, the short circuit terminal 3 may connect various terminal fittings such as male terminal fittings to each other.

In the preferred embodiment described above, the short circuit terminal 13 electrically connects the two female terminals 12*a* and 12*b* to each other, said two female terminals 12*a* and 12*b* overlapping with each other along the thickness direction of the connector 3. However, instead, the short circuit terminal 13 may electrically connect two terminal fittings to each other through the bending space 17 of the locking piece 18, said terminal fittings are arranged in parallel to each other along the width direction of the connector 3.

In the preferred embodiment described above, the short circuit terminal 13 has only one resilient contacting piece 23. However, instead, the short circuit terminal 13 may have two resilient contacting pieces 23 so that the two resilient contacting pieces 23 come in contact with the female terminals 12*a* and 12*b*.

The present invention is preferably applied to a connector unit 1, in which when the connectors 2 and 3 are separated from each other, the short circuit terminal 13 connects two terminal fittings to each other, while when the connectors 2 and 3 are coupled with each other, the connection between the two terminal fittings attained by the short circuit terminal 13 is removed, rather than to a general joint connector in which a short circuit terminal 13 always connects two terminal fittings to each other.

The connector 3 may include at least two female terminals.

The aforementioned preferred embodiments are described to aid in understanding the present invention and variations may be made by one skilled in the art without departing from the spirit and scope of the present invention.

What is claimed is:

1. A connector comprising:

at least two terminal fittings;

a connector housing including terminal-receiving chambers each receiving the terminal fitting and having a locking piece for locking the terminal fitting; and a short circuit terminal for electrically connecting the two terminal fittings to each other, wherein when the connector is coupled with a mating connector, electrical connection between the two terminal fittings attained by the short circuit terminal is removed, wherein when the terminal fitting is inserted into the terminal-receiving chamber, the locking piece is once resiliently deformed and thereafter locks the terminal fitting, wherein the connector housing is provided with a bending space in which the locking piece is positioned when the locking piece is resiliently deformed, and wherein the short circuit terminal includes a resilient contacting piece which passes through the bending space and comes in resilient contact with one terminal fitting of the two terminal fittings and a contacting piece which comes in contact with another terminal fitting of the two terminal fittings.

2. The connector according to claim 1, wherein the short circuit terminal is arranged between the two terminal fittings.

3. A connector unit comprising:

a connector according to claim 1; and a mating connector which is to be coupled with the connector and includes a releasing part for removing connection between the two terminal fittings attained by the short circuit terminal when the mating connector is coupled with the connector.

4. The connector unit according to claim 3, wherein the releasing part is provided at a position where the releasing part is enterable in the bending space when the connector and the mating connector are coupled with each other.

5. The A connector comprising at least two terminal fittings;

a connector housing including terminal-receiving chambers each receiving the terminal fitting and having a locking piece for locking the terminal fitting; and a short circuit terminal for electrically connecting the two terminal fittings to each other, wherein when the connector is coupled with a mating connector, electrical connection between the two terminal fittings attained by the short circuit terminal is removed, wherein when the terminal fitting is inserted into the terminal-receiving chamber, the locking piece is once resiliently deformed and thereafter locks the terminal fitting, wherein the connector housing is provided with a bending space in which the locking piece is positioned when the locking piece is resiliently deformed, wherein the short circuit terminal includes a resilient contacting piece which passes through the bending space and comes in resilient contact with one terminal fitting of the two terminal fittings, and a contacting piece which comes in contact with another terminal fitting of the two terminal fittings, and further comprising a spacer which is detachable from the connector housing and prevents the terminal fitting from coming out from the terminal-receiving chamber when the spacer is attached to the connector housing, wherein the spacer includes a restricting part for restricting part for restricting resilient deformation of the locking piece when the restricting part is attached to the connector housing, wherein the restricting part is provided with a through hole which passes the resilient contacting piece therethrough and allows the resilient contacting piece to come in contact with the one terminal fitting.

* * * * *